United States Patent [19]

Kessler

[11] Patent Number: 4,559,686

[45] Date of Patent: Dec. 24, 1985

[54] METHOD OF ASSEMBLING A HERMETIC COMPRESSOR

[75] Inventor: Donald L. Kessler, Tecumseh, Mich.

[73] Assignee: Tecumseh Products Company, Tecumseh, Mich.

[21] Appl. No.: 747,371

[22] Filed: Jun. 19, 1985

Related U.S. Application Data

[60] Continuation of Ser. No. 565,524, Dec. 28, 1983, abandoned, which is a continuation of Ser. No. 395,477, Jul. 6, 1982, abandoned, which is a division of Ser. No. 158,574, Jun. 11, 1980, Pat. No. 4,406,590.

[51] Int. Cl.[4] ..... B23P 15/10

[52] U.S. Cl. ..... 29/156.5 R; 29/156.4 R; 74/579 E; 74/595; 92/128; 123/193 P; 123/197 A; 123/197 AB; 123/197 AC; 417/415; 417/902

[58] Field of Search ..... 29/156.4 R, 156.5 R, 29/156.5 A; 74/579 R, 579 E, 595; 92/128; 123/197 A, 197 AB, 197 AC, 193 P; 417/415, 902

[56] References Cited

U.S. PATENT DOCUMENTS

| | | | |
|---|---|---|---|
| 1,890,914 | 12/1932 | Parsons, Sr. | 29/156.4 R |
| 2,396,084 | 3/1946 | Clark | 403/155 |
| 3,189,255 | 6/1965 | Enemark | 417/415 |
| 3,245,705 | 4/1966 | Fangman | 287/20 |
| 3,528,346 | 9/1970 | Lee | 92/128 |
| 3,564,978 | 2/1971 | Flitz | 92/187 |
| 3,877,350 | 4/1975 | Early et al. | 74/579 R |
| 3,903,752 | 9/1975 | Riffe | 74/579 E |
| 3,906,603 | 9/1975 | Romer et al. | 29/156.4 R |
| 4,106,881 | 8/1978 | Stannow et al. | 417/902 |
| 4,115,035 | 9/1978 | Tankred et al. | 29/156.4 R |
| 4,178,140 | 12/1979 | Tankred | 123/197 AB |

FOREIGN PATENT DOCUMENTS

| | | | |
|---|---|---|---|
| 976088 | 5/1975 | Fed. Rep. of Germany . | |
| 7516226 | 2/1976 | Fed. Rep. of Germany . | |
| 1235771 | 5/1960 | France . | |
| 2361555 | 3/1978 | France . | |
| 5966 | 3/1971 | Japan . | |
| 8908 | 3/1971 | Japan . | |
| 10357 | 4/1971 | Japan . | |
| 24437 | 11/1972 | Japan . | |
| 52150 | 4/1976 | Japan . | |
| 24804 | 6/1977 | Japan . | |
| 6152 | of 1911 | United Kingdom | 92/128 |
| 153685 | 11/1920 | United Kingdom | 29/156.5 A |

OTHER PUBLICATIONS

Riffe, D. R., "High Efficiency Reciprocating Compressors", from ASHRAE Journal, Sep., 1975.

*Primary Examiner*—Charlie T. Moon
*Assistant Examiner*—Ronald S. Wallace
*Attorney, Agent, or Firm*—Albert L. Jeffers; Anthony Niewyk

[57] ABSTRACT

The invention relates to a small, efficient hermetic compressor for refrigeration wherein reduction in size and minimization of parts is emphasized. The motor compressor unit is mounted within a sealed outer housing and comprises a cast crankcase, which is connected to the stator of the electrical motor by means of only three connecting screws that extend through the stator and are threadedly received in sockets in the downwardly depending legs of the crankcase. The crankshaft is pressed into the motor rotor and is journaled within the crankcase for rotation about a vertical axis. The crankcase includes a slot extending into the cylinder so that the connecting rod can be inserted laterally into the cylinder at the same time that it is slipped over the end of the crankshaft, and the wrist pin is then inserted through the same slot, through the piston and connecting rod, and is held in place by a spring clip. The compressor unit is resiliently mounted in the housing by means of four mounting spuds, which are press fit over the heads of the aforementioned connecting screws, and a fourth screw extending through the stator, and are resiliently captured within four coil springs connected to the base of the outer housing. In order to broaden the base of support for the compressor unit, the sockets receiving the heads of the screws are eccentric relative to the respective axes of the fingers of the spuds that are received in the coil springs.

3 Claims, 21 Drawing Figures

METHOD OF ASSEMBLING A HERMETIC COMPRESSOR

This is a continuation of application Ser. No. 565,524, filed Dec. 28, 1983 now abandoned, which is a continuation of application Ser. No. 395,477, filed July 6, 1982, now abandoned, which is a division of application Ser. No. 158,574, filed June 11, 1980, now U.S. Pat. No. 4,406,590 issued Sept. 27, 1983.

BACKGROUND OF THE INVENTION

The present invention relates to a hermetic motor compressor unit, particularly to such a unit which is intended for use in small capacity applications, such as small refrigerators.

One of the primary concerns in designing refrigeration compressors for use in small capacity applications is that of minimizing the overall size of the unit without sacrificing efficiency or the capacity which is required. A further design consideration is that of minimizing the number of parts required and the assembly time. This is particularly important in small compressors because the manufacturing volume of such compressors is normally quite high and even small savings in material and labor reaches considerable proportions when high production levels are attained.

One of the assembly operations performed in manufacturing such a compressor is that of assembling the connecting rod to the crankshaft and piston. Because the connecting rod articulates about the piston wrist pin only in directions transverse to the axis of the crankshaft, it is impossible, when using most conventional techniques, to insert the connecting rod over the end of the crankshaft when the connecting rod is attached to the piston. One technique for assembling the connecting rod to the crankshaft is the use of a split sleeve-type connecting rod wherein the sleeve halves are assembled around the crankshaft and secured together by means of bolts. The problem with this technique is that additional parts are required and there is a substantial amount of labor in assembling the connecting rod around the crankshaft. Furthermore, the split sleeve is a difficult part to manufacture due to the necessity for accurate machining of the mating surfaces thereof.

A further solution to the problem would be to initially install the piston and connecting rod assembly into the crankcase and then insert the crankshaft through the open loop bearing end of the connecting rod. This solution is not feasible in the case of the compressor in question, however, wherein the crankshaft is disposed vertically and must have a relatively large bearing surface in contact with the supporting surface of the crankcase. This would require a correspondingly large opening in the connecting rod, which is not practical in very small compressors wherein the connecting rod is generally small. Although the connecting rod could be lengthened to accommodate the larger opening, this would increase the overall size of the compressor in the direction of the connecting rod. As mentioned earlier, minimizing the overall size of the unit is one of the design criteria of compressors of this type.

U.S. Pat. No. 3,903,752 discloses yet another solution to the problem of assembling the piston, connecting rod and crankshaft. The wrist pin and connecting rod form a unitary assembly, which is inserted into the cylinder through a slot in the sidewall thereof at the same time that the integral, open loop bearing end of the connecting rod is slipped over the end of the crankshaft. There is a corresponding slot in the piston which enables the connecting rod-wrist pin assembly to be inserted. The primary difficulty to this technique is that the wrist pin portion of the connecting rod-wrist pin assembly is not permitted to bear fully on the openings in the piston. Because a slot in the piston is necessary to permit insertion of the assembly, the wrist pin assembly bears only on the top and sides of the opening in the piston, rather than around the entire periphery of the wrist pin as in conventional designs. This presents a serious problem in low temperature compressors wherein the compression ratio is much higher and, consequently, the forces between the wrist pin and piston are high. It will be appreciated that the loss of part of the bearing surface will result in higher forces per unit area on the remaining bearing surfaces. Another difficulty is the complicated structure of the connecting rod and wrist pin assembly, which makes machining more difficult. Moreover, maintaining squareness of the connecting rod relative to the crankshaft and piston is much more difficult to achieve than in the case where the connecting rod is joined to the piston by a separate, cylindrical wrist pin.

SUMMARY OF THE INVENTION

The above-discussed disadvantages and problems of prior art compressors are overcome by the compressor according to the present invention.

Overcoming the difficulty of assembling the connecting rod to the piston and crankshaft without resorting to a two-piece, split end connecting rod is accomplished by inserting the connecting rod over the free end of the crankshaft and at the same time inserting the opposite end of the connecting rod in the cylinder through a slot in the sidewall thereof. Rather than forming the connecting rod and wrist pin as a separate assembly which is then inserted through a slot in the cylinder side wall and through a slot in the piston, the present invention provides for first inserting the connecting rod and then inserting the piston over the top of the connecting rod. Following this, the wrist pin is inserted through the same slot in the cylinder wall through the aligned openings in the piston and connecting rod end. A wrist pin is secured in place by means of an internally disposed spring clip.

This arrangement is advantageous because it permits the wrist pin to bear against the surfaces of the aligned openings in the piston about its entire periphery at all times, as opposed to one of the prior art techniques wherein a slot in the piston to accommodate the connecting rod and wrist pin assembly reduces the bearing surface. This is particularly important in low temperature compressors of this type wherein the compression ratio and, accordingly, the loading of the wrist pin, is quite high. This arrangement is also advantageous because it utilizes simply constructed parts which are easy to manufacture and assemble and squareness of the connecting rod relative to the piston and crankshaft can be maintained without difficulty. Additionally, the crankshaft eccentric on which the connecting rod is journaled can be made small and can be positioned very close to the main bearing.

The compressor according to this aspect of the invention comprises a crankcase having a cylinder therein, a crankshaft rotatably received in the crankcase, a piston slidably received in the cylinder, and a connecting rod. The connecting rod comprises a first closed loop end received over a journal portion of the crankshaft and a second closed loop end wherein the second end is in register with a slot provided in the sidewall of the cylinder when the crankshaft and connecting rod are in their bottom dead center positions, whereby the connecting rod second end can be inserted into the cylinder at the same time that the first end is slid over the end of the crankshaft. A cylindrical wrist pin is journaled in the second closed loop end of the connecting rod and in aligned openings in the piston, and is completely encircled by the openings and second closed loop end of the connecting rod. The wrist pin is in register with the slot in the cylinder sidewall when the connecting rod and crankshaft are in the bottom dead center position whereby the wrist pin can be inserted through the cylinder sidewall into the piston.

The invention relates to a method of assembling a piston and connecting rod in a compressor comprising a crankcase having a cylinder therein, a cylinder sidewall including a slot therein, and a crankshaft rotatably connected to the crankcase. The method comprises the steps of slipping a connecting rod having a first closed loop end over a free end of the crankshaft such that the closed loop end is journaled on the crankshaft while at the same time inserting an opposite second closed loop end of the connecting rod through the cylinder sidewall slot into the cylinder, then inserting a piston through the cylinder and over the second closed loop end of the connecting rod. The wrist pin is inserted through the cylinder sidewall slot and then through an opening in the piston and through the second closed loop end of the connecting rod into an aligned second opening in the piston so as to connect the connecting rod and piston together.

It is an object of the present invention to provide a small hermetic motor compressor unit wherein assembly of the piston, connecting rod and crankshaft is facilitated without reducing the amount of bearing surface between the wrist pin and piston.

Yet another object of the present invention is to provide a small, quiet, efficient and relatively inexpensive hermetic compressor for use in small capacity refrigeration applications.

These and other objects of the present invention will become apparent from the detailed description of a preferred embodiment considered together with the accompanying drawings.

DESCRIPTION OF THE PREFERRED EMBODIMENT

Figure 2:
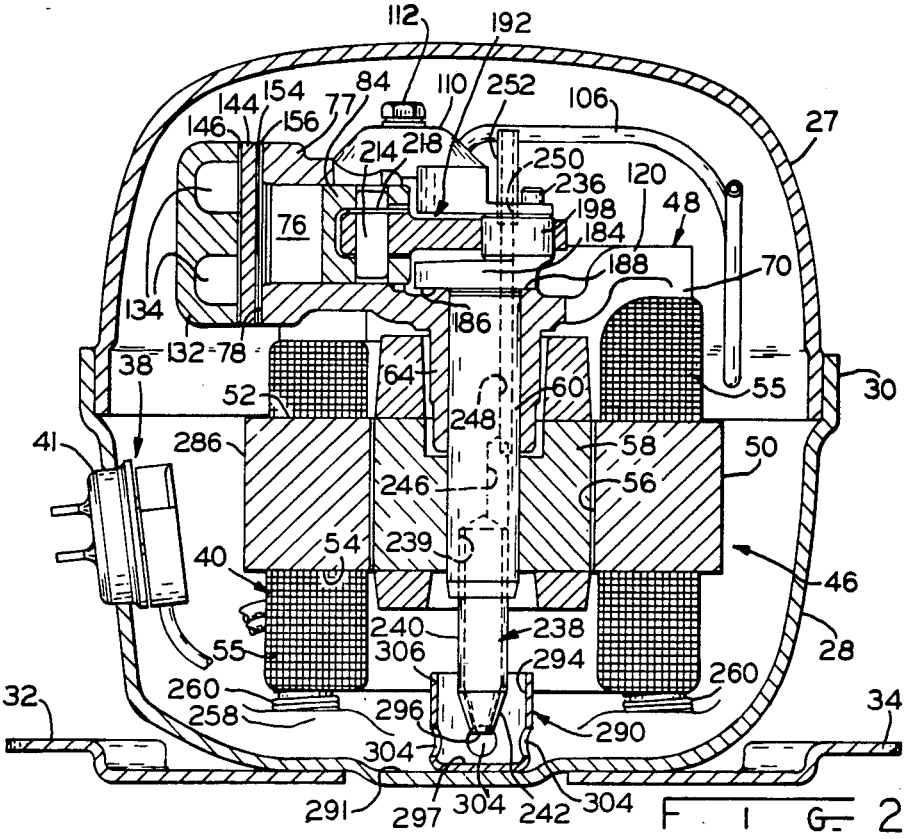
FIG. 2 is a sectional view taken along line 2—2 of FIG. 1 and viewed in the direction of the arrows.

Referring now to the drawings in detail, FIGS. 1-4 illustrate various views of the assembled compressor. The compressor is mounted within a hermetically sealed outer housing 26 comprising upper and lower halves 27 and 28, respectively, which are welded or brazed together along seam 30. A pair of mounting ears 32 and 34 are welded or brazed to the bottom of housing lower half 28 and include openings 36 to enable mounting to the frame of the refrigerator or other device in which the compressor is incorporated.

A conventional multiple pin terminal 38 (FIG. 2) provides for electrical connection between an external source of supply to the field winding 40 in a manner well known in the art. Terminal 38 includes a cup member 41 which extends through and is brazed or welded to the lower housing half 28.

Suction tube 42 and discharge tube 44 extend through the housing lower half 28 and are welded or brazed in place. Suction tube 42 connects to the evaporator (not shown) of the refrigeration system and discharge tube 44 connects to the condenser (not shown) thereof.

The motor-pump unit of the compressor comprises an induction motor 46 to which is secured crankcase 48. Motor 46 comprises a stator 50 made up of a stack of laminations having a generally circular array of vertical slots (not shown) therethrough within which are wound the coils making up the field windng 40. Extending out of the upper surface 52 and lower surface 54 of stator 50 are the end turns 55 of the field winding, and these are configured in a generally toroidal shape concentric with the axis of the motor 46. Preferably, the slots in stator 50 in which the field windings 40 are disposed extend radially inward to the circular central opening 56 of stator 50. A conventional rotor 58 is press fit over crankshaft 60, which is rotatably supported within crankcase 48 in a manner to be described below, and is concentrically disposed within the central opening 56 of stator 50. A very uniform, concentric air gap is defined between rotor 58 and stator 50.

Figure 5:
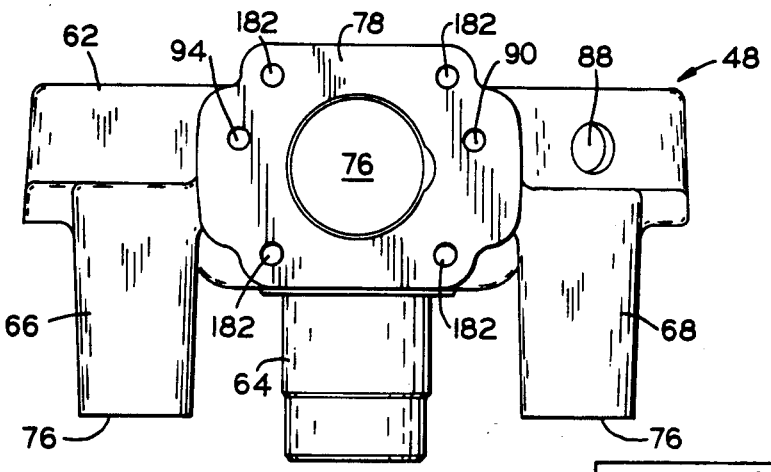
FIG. 5 is an elevational view of the crankcase viewed from the cylinder end.
Figure 6:
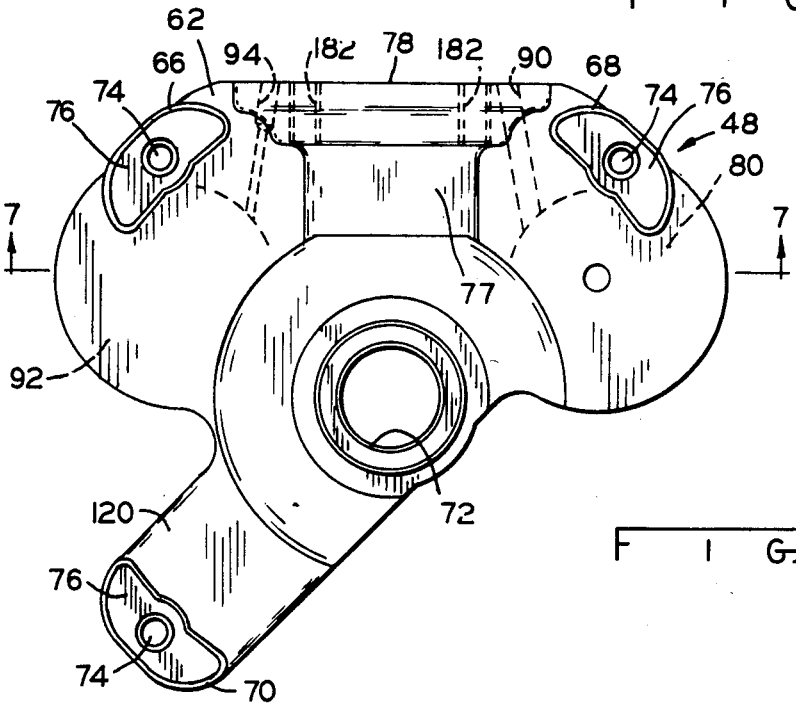
FIG. 6 is a bottom view of the crankcase shown in FIG. 5.
Figure 7:
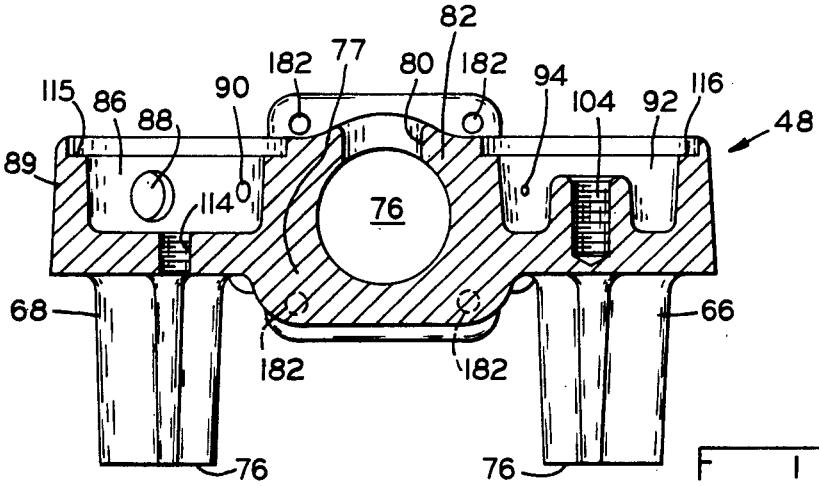
FIG. 7 is an inverted sectional view taken along line 7—7 of FIG. 6 and viewed in the direction of the arrows.

Referring now to FIGS. 5, 6 and 7, crankcase 48 is of integral construction made of 30,000 UTS gray cast iron. It comprises an upper web portion 62, a central crankshaft bearing portion 64 depending from web portion 62, and three mounting legs 66, 68 and 70 depending from web portion 62. Crankshaft bearing portion 64 includes a cylindrical opening 72 therein, and the axial centers of legs 66, 68 and 70 intersect radii at points equidistant from the axis of crankshaft opening 72 wherein the center of leg 68 is spaced 90° from the center of leg 66 and 180° from the center of leg 70. The center of leg 70 is spaced 90° from the center of leg 66. Threaded sockets 74 are provided in the lower surfaces 79 of legs 66, 68 and 70 at the respective centers thereof.

A cylinder 76 is machined in crankcase 48 and extends completely through web portion 62 from a position just radially outward of the crankcase opening 72 to the flat, machined surface 78 illustrated in FIG. 5. The central axis of cylinder bore 76 coincides with a radius extending from the central axis of crankshaft opening 72, and this radius is spaced angularly 45° from the radii of the threaded sockets 74 of mounting legs 66 and 68. A somewhat arcuate slot 80 (FIGS. 1 and 7) extends through the sidewall 82 of cylinder 77. The purpose of slot 80 is to facilitate assembly of the connecting rod to the piston 84 and crankshaft 60 in a manner to be described in detail below. An intake muffler chamber 86 is formed within web portion 62 and an intake opening 88 is provided in the side wall 89 thereof. A suction port 90 extends from suction muffler chamber 86 to the machined surface 78 of crankcase 48. A discharge muffler 92 is also formed in web portion 62 of crankcase 48, and a discharge port 94 extends from chamber 92 to the flat surface 78 of crankcase 48. It will be noted that suction muffler 86 and discharge muffler 92 are positioned on opposite sides of cylinder bore 76 and the centers thereof are equidistantly spaced from the vertical plane intersecting the central axis of bore 76.

Figure 1:
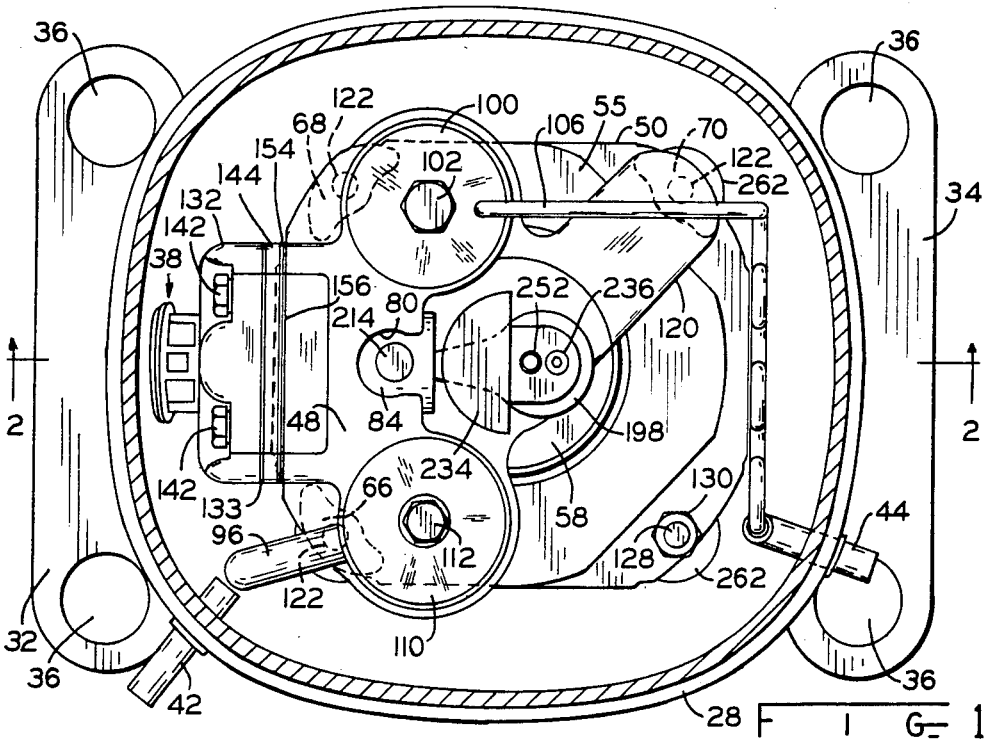
FIG. 1 is a top view of the compressor according to the present invention wherein the upper portion of the outer housing has been removed.
Figure 3:
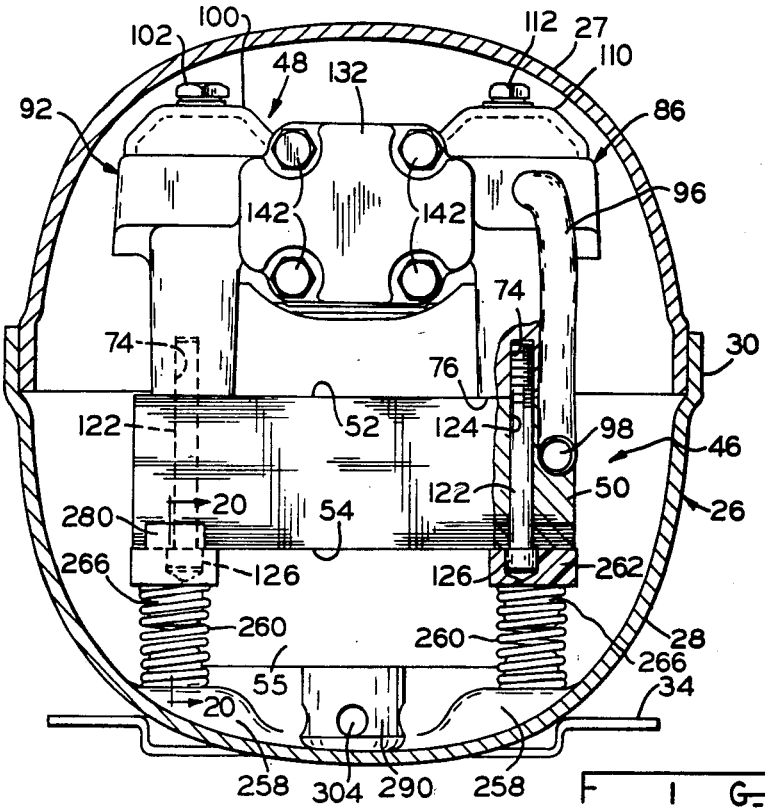
FIG. 3 is an elevational view of the compressor viewed from the left end of FIG. 1 wherein a portion of the outer housing has been removed.

As shown in FIGS. 1 and 3, suction tube 96 is secured to suction inlet 88 and is provided with a 90° bend so that it extends downwardly before terminating in opening 98. The present compressor includes the feature of semidirect suction, which means that the opening 98 of the internal suction tube 96 is in direct alignment with the opening of the suction tube 42 (FIG. 1) that extends through housing 26 and is connected to the evaporator of a refrigeration system. This arrangement reduces the suction gas superheating and results in improved efficiency of the compressor. Preferably, the opening 98 of suction tube 96 is cut at a 45° angle relative to the longitudinal axis of the downwardly extending portion thereof.

Figure 4:
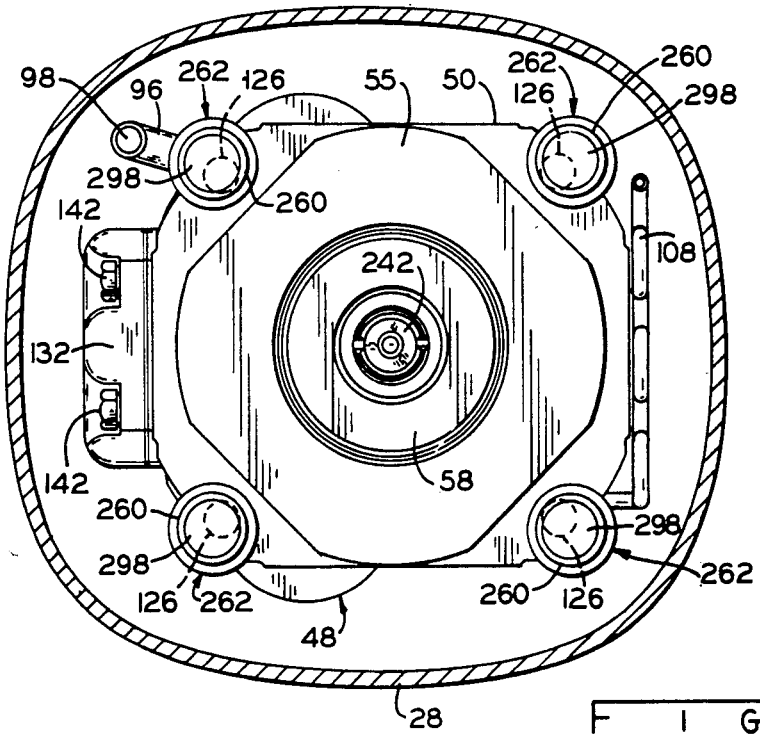
FIG. 4 is a bottom view of the compressor wherein a lower portion of the outer housing has been removed.

A hollow, generally frustoconical shaped cover 100 is positioned over discharge muffler 92 and is secured to muffler 92 by means of a screw 102 extending therethrough and being threadedly received within socket 104. The discharge gas shock loop 106 is connected to and extends through cover 100 into the interior of muffler chamber 92, and connects to discharge tube 44 as illustrated in FIG. 1. In order to avoid overstressing of shock loop 106 as the resiliently mounted pump unit moves within housing 26, shock loop 106 is bent to form convolutions 108 as illustrated in FIG. 4. Suction muffler chamber 86 is also provided with a hollow, generally frustoconically shaped cover 110, and is secured over chamber 86 by screw 112, which is threadedly received within socket 114 (FIG. 7). Covers 100 and 110 are seated on annular shoulders 115 and 116 at the upper ends of chambers 86 and 92, respectively.

As discussed above, crankcase 48 is supported on three legs 66, 68 and 70, as opposed to prior art compressors wherein the crankcase has a four point support, and the legs are angularly spaced by 90°. Leg 70 is joined to the central portion of web portion 62 by bridge portion 120, and legs 68 and 66 are connected directly to the main part of web portion 62.

Crankcase 48 is connected to stator 50 by means of three screws 122, which pass through clearance openings 124 in stator 50 and are threadedly received in sockets 74 in legs 66,68 and 70 (FIG. 3). Screws 122 are preferably cap screws having cylindrical heads 126 which protrude beyond the lower surface 54 of stator 50. Although not utilized to connect crankcase 48 to stator 50, a fourth screw 128 also extends upwardly through clearance openings in stator 50 and is connected thereto by nut 130, which is tightened down against the upper surface 52 of stator 50. When screws 122 are tightened, crankcase 48 is drawn downwardly against the upper surface 52 of stator 50, and the three mounting legs 66, 68, and 70 provide an extremely stable connection between crankcase 48 and stator 50. As will be appreciated, this results in a substantially smaller crankcase because of the open area over that portion of the motor 46 around the fourth connecting screw 128 as illustrated in FIG. 1.

Figure 12:
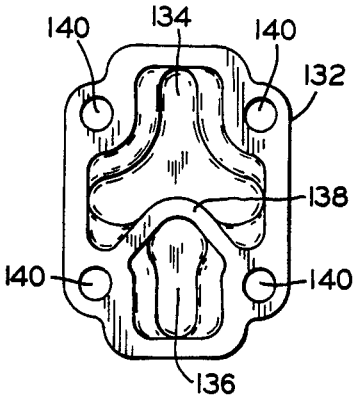
FIG. 12 is a bottom view of the cylinder head.

The valving arrangement for the suction and discharge gases will now be described. The cylinder head 132 illustrated in FIG. 12 is made of 30,000 UTS gray cast iron and comprises a generally triangularly shaped discharge chamber 134 and a smaller, slightly elongated suction chamber 136 separated from each other by web 138. Head 132 includes four clearance holes 140 for bolts 142 (FIGS. 1, 3 and 4).

Head 132 is disposed over valve plate 144 (FIG. 13), which has an outer periphery in the lateral direction of the same shape as that of head 132. The lower surfaces 146 (FIG. 2) of head 132 are sealed against valve plate 144 by means of a suitably shaped gasket 133 (FIG. 1). Valve plate 144, which is made of cast iron, is provided with four clearance holes 148 for bolts 142, and also includes a discharge passage 150 communicating with discharge chamber 134 in head 132 and a suction passage 152 communicating with suction chamber 136 in head 132.

Figure 15:
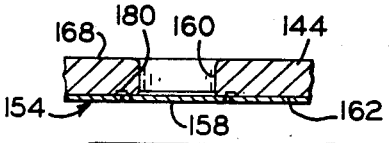
FIG. 15 is a sectional view taken along line 15—15 of FIG. 13 and viewed in the direction of the arrows.

Leaf plate 154, which is made of bright polished flapper valve steel, is sandwiched between valve plate 144 and leaf plate gasket 156. Leaf plate 154 and leaf plate gasket 156 each have the same peripheral shape as head 132 and valve plate 144. Leaf plate 154 includes an elongated leaf valve portion 158 stamped therein and joined to leaf plate 154 by an integral hinge portion generally in accordance with conventional leaf valve design employed in prior art compressors. The end portion of leaf valve 158 is positioned directly below suction opening 160 (FIGS. 13 and 15), and is pressed into sealing engagement with the lower surface 162 of valve plate 144 by the compressed gases produced during the compression stroke of piston 84. On the suction stroke of piston 84, however, the partial vacuum within cylinder bore 76 will draw leaf valve 158 away from the lower surface 162 of valve plate 144 and permit refrigerant within suction chamber 136 to pass through opening 160 into cylinder bore 76. Suction passage 152 (FIG. 13) is aligned with a similar opening (not shown) in leaf plate 154, which, in turn, is in alignment with suction port 90 (FIGS. 5, 6 and 7). Thus, refrigerant is drawn from suction muffler 86 through suction port 90 and passage 152 in valve plate 144 into suction chamber 136, and from there downwardly through opening 160 and past leaf valve 158 into cylinder bore 76.

Figure 13:
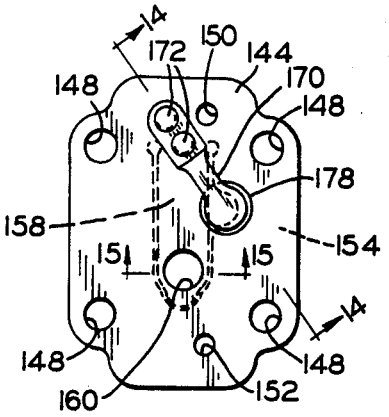
FIG. 13 is a top view of the valve plate and leaf plate assembly.
Figure 14:
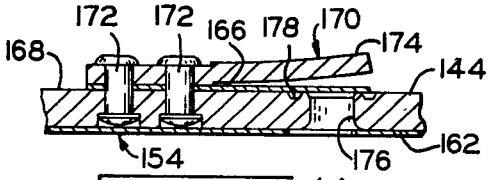
FIG. 14 is a sectional view taken along line 14—14 of FIG. 13 and viewed in the direction of the arrows.
Figure 21:
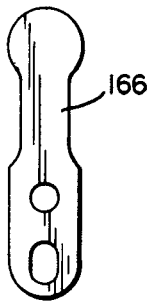
FIG. 21 is a detail of the discharge valve.

Referring now to FIGS. 13 and 14, discharge leaf valve 166 (FIG. 21), which is made of the same material as leaf plate 154, is connected to the upper surface 168 of valve plate 144 by discharge valve retainer 170 and rivets 172. It will be noted that leaf valve retainer 170 includes a curved portion 174, which overlies the movable portion of discharge leaf valve 166 and limits the upward movement thereof. A discharge opening 176 is positioned directly beneath discharge leaf valve 166 and communicates with piston bore 76. Discharge gas passage 150 (FIG. 13) is in alignment with an opening in leaf plate 154 and with discharge port 94 (FIGS. 5 and 6). On the piston compression stroke, the refrigerant flows upwardly through opening 176, past open discharge valve 166 into discharge chamber 134, and from there back through discharge port 94 into discharge muffler 92. The pressurized refrigerant flows out of discharge muffler 92 through discharge shock loop 106 and discharge tube 44 to the condenser of the refrigeration system.

Valve plate 144 includes annular grooves 178 and 180 concentric with openings 176 and 160, respectively. The valve assembly described above is secured to the flat surface 78 of crankcase 48 by screws 142, which are threadedly received in four corresponding threaded sockets 182 in crankcase 48 (FIGS. 5, 6 and 7).

With reference to FIGS. 1, and 8–11, the piston and connecting rod assembly and the manner of assembling the same will be described. Crankshaft 60, which is best illustrated in FIG. 2, is journaled within the central sleeve portion 64 of crankcase 48 and includes a bearing portion 184 having a bearing surface 186 supported on the upper surface 188 of crankcase sleeve portion 64. The end of crankshaft 60 is formed as a circular eccentric 190, and when the crankshaft 60 is fully inserted in sleeve portion 64, eccentric 190 will be positioned directly opposite the central axis of cylinder bore 76. In assembly, crankshaft 60 is first inserted into crankcase 48 to the position shown in FIG. 2, and rotor 58 is then pressed over it.

Figure 8:
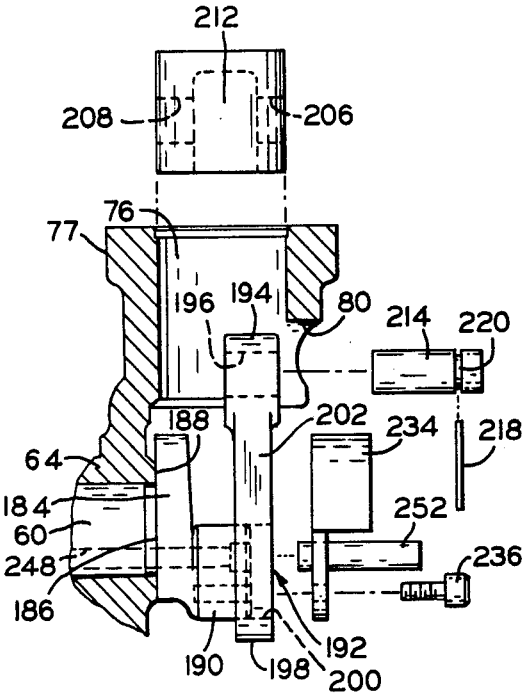
FIG. 8 is a fragmentary, exploded view of the piston and connecting rod assembly being assembled wherein the connecting rod is partially inserted into the cylinder and over the free end of the crankshaft.

The connecting rod 192 comprises a closed loop first end 194 having a circular opening 196 therein, and a closed loop second end 198 also having a circular opening 200 therein and connected to the first end 194 by a shank portion 202. FIG. 8 illustrates connecting rod 192 being inserted, and this is accomplished by slipping the opening 200 over the eccentric 190 of crankshaft 60. If this is done with eccentric 190 at the bottom dead center position illustrated in FIG. 8, slot 80 in the side wall of cylinder 77 will permit end 194 to drop into cylinder bore 76. It will be noted that slot 80 is generally the same shape as end 194 of connecting rod 192, and is located such that cylinder bore 76 will remain sealed even when piston 84 is in its bottom dead center position as illustrated in FIG. 2.

Figure 9:
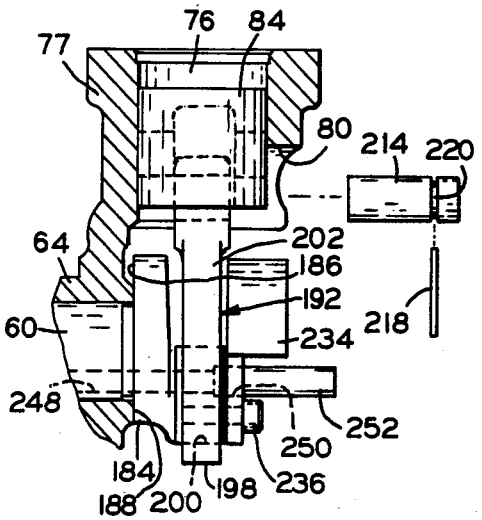
FIG. 9 is a view similar to FIG. 8 but wherein the connecting rod and counterweight have been completely assembled and the piston is being slid over the end of the connecting rod.

After connecting rod 192 has been inserted to the position illustrated in FIG. 9, piston 84 is inserted through the opposite end of cylinder bore 76 as shown in FIG. 9 over the end 194 of connecting rod 192. It is necessary to assemble piston 84 prior to the cylinder head and valve assembly. Piston 84 comprises a pair of aligned openings 206 and 208 extending through its skirt 210 to the interior 212 thereof. Openings 206 and 208, which are circular in cross section, have axes which intersect the longitudinal axis of piston 84.

Figure 10:
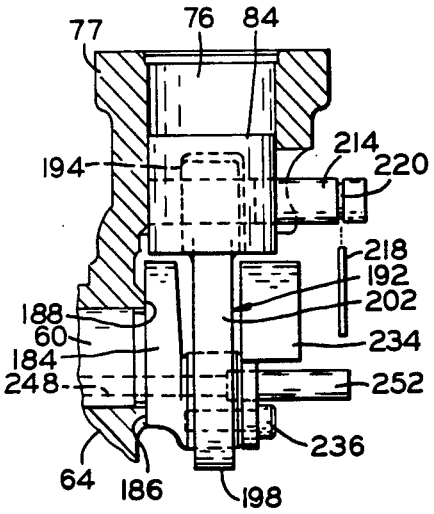
FIG. 10 is a view similar to FIGS. 8 and 9 wherein the wrist pin is now being inserted through the piston and connecting rod.
Figure 11:
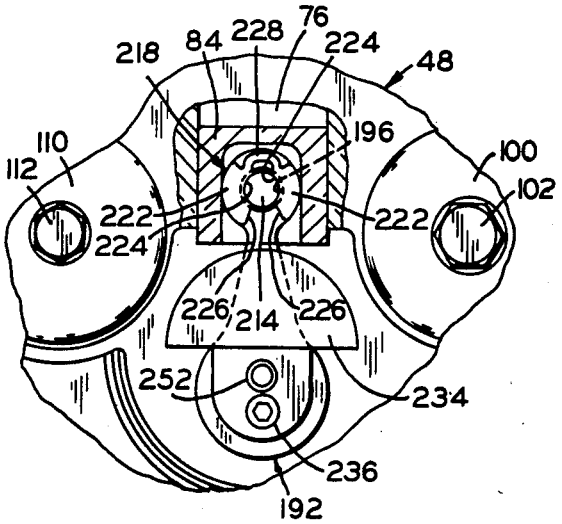
FIG. 11 is a fragmentary, top view of the assembled piston and connecting rod assembly wherein a portion of the piston has been removed to illustrate the details of construction.

When piston 84 has been inserted to the position shown in FIG. 10, cylindrical wrist pin 214 is dropped in place through opening 206, then through the opening 196 in connecting rod 192, and finally into opening 208 in piston 84. It will be appreciated that, when crankshaft 60 is in the bottom dead center position, wrist pin 214 can be inserted through the slot 80 in the sidewall of cylinder 77. FIGS. 2 and 11 illustrate the manner in which wrist pin 214 is held in place within piston 84. When wrist pin 214 has been slid to the position illustrated in FIG. 2, a generally C-shaped spring clip 218 is slipped over wrist pin 214 within a peripheral groove 220 therein and is positioned between and immediately adjacent to connecting rod end 194 and piston skirt inner side wall 121 within the interior space 212 of piston 84. Spring clip 218 comprises legs 222 having arcuate inner edges 224 and tapered edges 226. The distal end 228 of clip 218 functions as a hinge to permit legs 222 to spread as clip 218 is forced over wrist pin 214. The tapered edges 226 assist in spreading legs 222 as clip 218 is inserted, and since the inner, arcuate edges 224 lie on a circle having a diameter smaller than the outer diameter of wrist pin 214 and approximately the same size as the outer diameter of groove 220, spring clip 218 will be resiliently held in place. Clip 218 is inserted through the open, lower end of piston 84. Because spring clip 218 has a larger outer diameter than the openings 206 and 208 in piston 84, wrist pin 214 will be retained in place. FIG. 2 illustrates that wrist pin 214 is spaced inwardly from the opposite sides of piston 84 so as to avoid scoring the walls of cylinder bore 76.

Counterweight 234 is then connected to the end of crankshaft 60 by means of cap screw 236. The use of a detachable counterweight is advantageous because it allows for differences in counterweight size to compensate for variations in bore and stroke, the shaft eccentric 190 can be located adjacent to the main bearing 184, and it permits the use of a one-piece connecting rod 192. Counterweight 234 is attached to crankshaft 60 after the insertion of spring clip 218.

Lubrication of the compressor is provided by means of a conventional aluminum killed, steel pickup tube 238 having a generally cylindrical upper portion 240 and a tapered lower portion 242. Tube 238 is pressed into a drilled out portion 239 of crankshaft 60 and extends downwardly into the refrigerant and lubricant sump formed within the lower portion of outer housing 6. Tube 238 is in fluid communication with two drilled passages 246 and 248 in crankshaft 60, which are in alignment with an opening 250 in counterweight 234. A lubricant distribution tube 252 is pressed within opening 250 so that lubricant pumped upwardly by tube 238 will flow through passages 239, 246, 248 and opening 250 and then upwardly and out through lubricant tube 252. It is noted that tube 252 is positioned eccentrically with respect to the axis of rotation of crankshaft 60. Tube 252 preferably extends through opening 250 and is received within eccentric 190.

Figure 20:
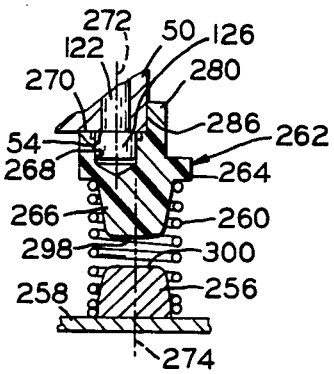
FIG. 20 is a sectional view taken along line 20—20 of FIG. 3 and viewed in the direction of the arrows.

The resilient mounting arrangement for the compressor to permit relative motion of the pump unit within outer housing 26 comprises four metal, generally cylindrical, and slightly tapered mounting spuds 256 welded or brazed to flats 258 formed in the lower half 28 of outer housing 26 (FIGS. 2 and 20). There are four such mounting spuds 256. Coil springs 260 are resiliently clamped over respective spuds 256 and extend upwardly in a general vertical direction from the bottom of outer housing 26.

Four upper mounting spuds 262 made of a suitable plastic material are positioned directly above the lower spuds 256 as illustrated in FIG. 20. Each of upper spuds 262 comprises a lateral flange portion 264, a generally frustoconical depending finger 266, which is resiliently clamped within coil spring 260, and a socket or recess 268, which is press fit over the heads 126 of the four connecting screws 122 and 128. The upper surface 270 of each of the upper spuds 262 are in abutment with the lower surface 54 of stator 50. Of primary importance is the fact that the central axis represented by dotted line 272 of circular sockets 268 is eccentric relative to the central axis shown as dotted line 274 of frusto-conical spuds 276 and 256. This permits the support centers of spuds 262 to be positioned further outward in a radial direction relative to the axis of rotation of crankshaft 60 than is the case with prior art mounting spuds of this type wherein the centers of support are coincident with the axes of the connecting screws 122. The relationship of mounting spuds 262 relative to connecting screws 122 is further illustrated in FIG. 4.

This arrangement is important in that it enables the support base for stator 50 and, therefore, for the entire compressor, to be larger than is the case with prior art compressors. Furthermore, the fact that the mounting spuds 262 and, therefore, springs 260 are further outward, the configuration of the end turns 55 of main winding 40 is not as critical because more space is available for the end turns 55. In order to properly position upper spuds 262, stop collars 280 are provided, and these collars have an inner arcuate surface 282 which generally conforms to the outer peripheral side surface 286 of stator 50. Stop collars 280 also serve to provide additional support in the lateral direction because they are in engagement with the sides 286 of stator 50.

The fingers 266 of upper spuds 262 extend axially within coil springs 260 and have a maximum outer dimension which is slightly larger than the inner dimension of coil springs 260 in their undeflected states so that fingers 266 are resiliently and frictionally clamped within springs 260.

The mounting devices described above, which comprise upper spuds 262, lower spuds 256 and coil springs 260, are positioned generally at the four corners of the stator 50. The major portions of the spuds 262, 256 and springs 260 are located radially outward of the heads of the connecting screws 122, and it will be seen that their respective axes are located at about the edge of stator 50. The size and positions of spuds 262 can be varied to adjust the location of the respective support axes, but it is generally preferable that the support axes are at or just slightly inward of the outer surface of stator 50.

The resilient mounting devices just described permit the motor-crankcase assembly to move slightly relative to outer housing 6. Not only do coil springs 260 permit a certain degree of upward and downward movement, but they also permit some lateral movement as well. This serves to lessen the transmission of shocks and vibration betwee the compressor and outer housing.

In order to prevent undue lateral movement of the motor-compressor unit within outer housing 26, a cup-shaped cage element 290 (FIGS. 2 and 16) is welded or brazed to the lower surface 291 of outer housing lower half 28. Lubricant pickup tube 238 extends downwardly into cage 290, and the clearance between the outer surface of cylindrical portion 240 and the inner surface 294 of cage 290 is selected such that the cylindrical portion 240 of tube 238 will contact the inner surface 294 of cage 290 before coil springs 260 and shock loop 106 are excessively deflected and before any of the internal structure can strike the sides of outer housing 26. Thus, cage 290 serves as a shipping stop in the lateral direction. The clearance between the lower end 296 of tube 238 and the bottom 297 of cage 290 is slightly greater than the clearance between the lower end 298 of spuds 262 and the upper ends 300 of the corresponding lower spuds 256 (FIG. 20) so that spuds 262 and 256 will engage each other before the lower end 296 of tube 238 strikes the bottom 297 of cage 290. The combination of lubricant tube 238, cage 290, and spuds 262 and 256 functions as shipping stops in the lateral and downwardly vertical directions. The up stop is accomplished by contact between a portion of the compressor and the inner surface of the upper housing half 27.

Figure 16:
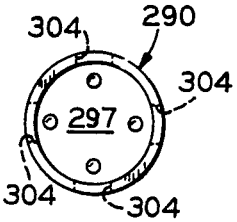
FIG. 16 is a top view of the retainer cage for the lubricant pickup tube.
Figure 17:
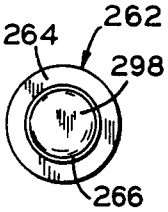
FIG. 17 is a bottom view of one of the mounting spuds.
Figure 18:
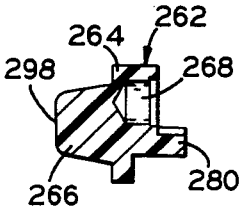
FIG. 18 is a sectional view taken along line 18—18 of FIG. 19 and viewed in the direction of the arrows.
Figure 19:
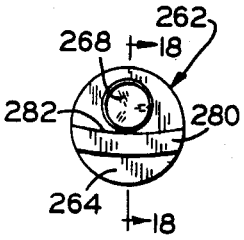
FIG. 19 is a top view of one of the mounting spuds.

In order to permit lubricant to flow to pickup tube 238, openings 304 are provided in the sides of cage element 290 as illustrated in FIGS. 2 and 16.

The particular shape of outer housing 26 has been designed so as to minimize the transfer of noise, and is disclosed in U.S. Pat. No. 4,384,635 issued May 24, 1983, entitled Continuous Curvature Noise Suppressing Compressor Housing, in the name of David C. Lowery and owned by the assignee of the present application.

In operation, when main windings 55 are energized, rotor 58 is caused to rotate within the central opening 56 of stator 50 thereby causing crankshaft 60 also to rotate. This causes piston 84 to reciprocate within cylinder bore 76. On the suction stroke of piston 84, the partial vacuum within cylinder bore 76 opens intake leaf valve 158 and draws refrigerant through intake tube 42, then through the opening 98 and intake tube 96 and into suction muffler 86. From suction muffler 86, the refrigerant flows through passage 90 into intake chamber 136 and downwardly through opening 160, past leaf valve 158 into bore 76. On the piston compression stroke, leaf valve 158 closes and discharge valve 166 opens thereby permitting the refrigerant to flow through opening 176, into discharge chamber 134, back through passage 150, through passage 94 and into discharge muffler 92. From there, the refrigerant flows outwardly through the opening in cover 100 through discharge shock loop 106 and discharge tube 44 to the condenser of the refrigeration system. This same sequence occurs for each revolution of crankshaft 60.

Lubricant pickup tube 238 is rotated by crankshaft 60 and pumps lubricant upwardly by centrifugal action in a manner well known in the art. The lubricant flows upwardly through passages 239, 246 and 248, and then through tube 252 whereby it is sprayed upwardly and drops by gravity through the compressor so as to lubricate the sliding parts thereof. It should be noted that the open configuration of crankcase 48 illustrated in FIG. 1 due to the three point support permits very good lubrication of the crankshaft bearings and of the piston.

While this invention has been described as having a preferred design, it will be understood that it is capable of further modification. This application, is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A method of assemblying a piston and connecting rod in a compressor comprising a crankcase having a cylinder therein including a sidewall, and a crankshaft rotatably connected to the crankcase, the piston having a skirt with an inner sidewall, said method comprising:

providing a slot in the cylinder sidewall, the slot being open in a direction generally facing the crankshaft and dimensioned to receive a first closed loop end of the connecting rod, with the crankshaft in substantially its final and bottom dead center position, inserting said first closed loop end of the connecting rod through said slot into the cylinder and simultaneously slipping a second closed loop end of said connecting rod over a free end of the crankshaft such that the second closed loop end is journaled on the crankshaft in final position, thereafter inserting the piston through a cylinder bore of said cylinder and over the first closed loop end of the connecting rod, there being one only narrow gap between a first surface of the first closed loop end and the piston skirt inner sidewall, the second surface of the first closed loop end being closely adjacent the piston skirt inner sidewall, inserting a cylindrical wrist pin through the cylinder slot and then through a first opening in the piston, through the first closed loop end of the connecting rod and into an aligned second opening in the piston so as to connect the piston and connecting rod together, the wrist pin having a circumferential groove therin and being completely encircled by the piston openings and connecting rod first closed loop end, the wrist pin being in registry with the cylinder slot when the connecting rod and crankshaft are substantially in their bottom dead center; and retaining the wrist pin in position after insertion thereof with one only C-shaped retainer by inserting the retainer into the one only narrow gap between a first surface of the connecting rod first end and the piston skirt inner sidewall, the C-shaped retainer being arcuate and open ended and having a larger diameter than said openings, said retainer comprising a pair of spaced apart legs having arcuate inner edges and tapered edges, said legs having a width dimension in the radial direction with respect to the axis of the wrist pin which is substantially larger than the thickness dimension of said legs in the axial direction of said wrist pin, said retainer further including a resilient distal end interconnecting said legs, the retainer being placed over the wrist pin such that the legs straddle the wrist pin and are in engagement with said groove and locked to the wrist pin, the retainer occupying substantially the entire narrow gap and having an interference fit with said groove between the connecting rod end and piston skirt inner sidewall to thereby lock the wrist pin against axial movement and retain the wrist pin within the piston, the second surface of said connecting rod first end being closely adjacent said piston skirt inner sidewall.

2. The method of claim 1 wherein the retainer is locked to the wrist pin by spreading apart the legs over the wrist pin and then causing the legs to move together to capture the wrist pin between them.

3. The method of claim 1 wherein the crankshaft is vertically oriented and is supported on a bearing surface of the crankcase as the connecting rod is slipped over the free end of the crankshaft.

* * * * *

UNITED STATES PATENT AND TRADEMARK OFFICE

CERTIFICATE OF CORRECTION

PATENT NO. : 4,559,686

DATED : December 24, 1985

INVENTOR(S) : Donald L. Kessler

It is certified that error appears in the above-identified patent and that said Letters Patent is hereby corrected as shown below:

Col. 4, line 60 change "windng" to --winding--.
Col. 5, line 21, change "crankcase" to --crankshaft--.
Col. 7, line 36, after "Figs. 1," insert --2--.
Col. 8, line 21, change "121" to --221--.
Col. 8, line 53, change "6" to --26--.
Col. 9, line 61, change "6" to --26--.
Col. 9, line 65, change "betwee" to --between--.
Cl. 1, Col. 11, line 35, change "therin" to --therein--.

Signed and Sealed this

*Twentieth* Day of *May 1986*

[SEAL]

*Attest:*

DONALD J. QUIGG

*Attesting Officer*

*Commissioner of Patents and Trademarks*